US006464562B1

(12) United States Patent
Chen

(10) Patent No.: US 6,464,562 B1
(45) Date of Patent: Oct. 15, 2002

(54) SYSTEM AND METHOD FOR IN-SITU MONITORING SLURRY FLOW RATE DURING A CHEMICAL MECHANICAL POLISHING PROCESS

(75) Inventor: Bing-Shin Chen, Hsinchu (TW)

(73) Assignee: Winbond Electronics Corporation (TW)

( * ) Notice: Subject to any disclaimer, the term of this patent is extended or adjusted under 35 U.S.C. 154(b) by 0 days.

(21) Appl. No.: 10/020,969

(22) Filed: Dec. 19, 2001

(51) Int. Cl.[7] ..... B24B 29/00

(52) U.S. Cl. ..... 451/5; 451/36; 451/41; 451/60; 451/446

(58) Field of Search ..... 451/5, 8, 28, 36, 451/41, 60, 285, 286, 287, 288, 289, 446

(56) References Cited

U.S. PATENT DOCUMENTS 4,851,666 A * 7/1989 Anderson et al. ..... 250/231 R
5,857,893 A * 1/1999 Olsen et al. ..... 451/5
6,074,286 A * 6/2000 Ball ..... 451/285
6,149,508 A * 11/2000 Vanell et al. ..... 451/56
6,183,341 B1 * 2/2001 Melcer ..... 451/5
6,267,641 B1 * 7/2001 Vanell et al. ..... 451/6
6,319,099 B1 * 11/2001 Tanoue et al. ..... 451/60

* cited by examiner

*Primary Examiner*—Eileen P. Morgan
*Assistant Examiner*—Hadi Shakeri

(57) ABSTRACT

A system and method for in-situ monitoring slurry flow rate during a chemical mechanical polishing process is provided. The present system comprises a chemical mechanical polishing apparatus with an impact pressure measuring device. The impact pressure measuring device serves in-situ monitoring of impact pressure generated by slurry at an outlet of slurry supply means. The flow rate of the slurry is controlled and adjusted in accordance with the measured impact pressure. The flow of the slurry is also ensured all through a chemical mechanical polishing process.

11 Claims, 7 Drawing Sheets

SYSTEM AND METHOD FOR IN-SITU MONITORING SLURRY FLOW RATE DURING A CHEMICAL MECHANICAL POLISHING PROCESS

BACKGROUND OF THE INVENTION

1. Field of the Invention

The present invention relates to an apparatus and method for fabricating integrated circuits, and more particularly, to an apparatus and method for chemical mechanical polishing integrated circuit wafers.

2. Description of the Prior Art

Chemical mechanical polishing is used in the semiconductor industry to fabricate integrated circuit wafers for higher degree of planarity and uniformity. Chemical mechanical polishing typically involves the removal of an oxide or tungsten layer from the surface of a wafer such that peaks and valleys are removed from the wafer surface. The removal process utilizes an abrasive slurry suspending in an alkaline or acidic solution to planarize the surface of the wafer through a combination of mechanical and chemical action.

FIGS. 1A and 1B are schematic diagrams showing a conventional chemical mechanical polishing machine. The chemical mechanical polishing machine comprises a polishing platen 10 on which a polishing pad 12 is layered, a polishing head 14 for holding a semiconductor wafer 16 in position, and an injector 18 for applying a mass of slurry to the semiconductor wafer 16 during the chemical mechanical polishing process. In use, the polishing platen 10 is rotated and an abrasive slurry is sprayed onto the polishing pad 12 of the polishing platen 10. Once the slurry has been applied to the polishing pad 12, the rotating polishing head 14 moves downward to press the semiconductor wafer 16 against the polishing pad 12. As the semiconductor wafer 16 is pressed against the polishing pad 12, the surface of the semiconductor wafer 16 is mechanically and chemically polished.

The slurry is very important for the chemical mechanical polishing process. The improper operating properties of the slurry result in a fatal influence for the chemical mechanical polishing process. The slurry flow rate is especially important for the chemical mechanical polishing process. It is a key factor for the chemical mechanical polishing process to select a proper flow rate of the slurry and in-situ monitoring the flow rate during the chemical mechanical polishing process to ensure the flow rate of the slurry is under control.

However, for the conventional chemical mechanical polishing machine, a flow rate meter is usually disposed between the slurry pipes for monitoring the flow rate of the slurry during the chemical mechanical polishing process. The problems with the slurry flow rate, for example, slurry leakage, broken pipes etc, sometimes occurr after passing through the flow rate meter. As a result, the slurry flow is not supplied unto the polishing pad 12. This situation is not detected by the flowrate meter.

Accordingly, it is an intention to provide an apparatus and method for in-situ monitoring slurry flow rate during a chemical mechanical polishing process, which can overcome the above drawback encountered in the conventional chemical mechanical polishing machine.

SUMMARY OF THE INVENTION

It is an objective of the present invention to provide a system for in-situ monitoring slurry flow rate during a chemical mechanical polishing process, which can in-situ monitor a flow rate of slurry at a predetermined position approximating to an outlet of a slurry supplier during a chemical mechanical polishing process, so as to ensure flow of the slurry all through the chemical mechanical polishing process.

It is another objective of the present invention to provide a system for in-situ monitoring slurry flow rate during a chemical mechanical polishing process, which combines a chemical mechanical polishing apparatus with an impact pressure measuring device, and a flow rate of slurry supplied unto the chemical mechanical polishing apparatus which is controlled and adjusted according to impact pressure measured by the impact pressure measuring device, generated by the flow rate of the slurry.

It is a further objective of the present invention to provide a system for in-situ monitoring slurry flow rate during a chemical mechanical polishing process, which positions an impact pressure measuring device on a surface of a polishing platen so as to facilitate a polishing pad adhering unto the polishing platen. It is still a further objective of the present invention to provide a method for in-situ monitoring slurry flow rate during a chemical mechanical polishing process, which can in-situ monitor a flow rate of slurry during a chemical mechanical polishing process, and accordingly controlling and adjusting the flow rate of the slurry.

In order to achieve the above objectives, the present invention provides a system and method for in-situ monitoring slurry flow rate during a chemical mechanical polishing process. The present system comprises a chemical mechanical polishing apparatus with an impact pressure measuring device, circuit means for converting impact pressure to a flow rate, means for controlling a flow rate and slurry supply means. The impact pressure measuring device serves in-situ monitoring of the impact pressure generated by slurry flowing through and then supplied unto the chemical mechanical polishing apparatus during a chemical mechanical polishing process. Circuit means for converting impact pressure to a flow rate that serves the converting of the impact pressure to the flow rate of the slurry. When the flow rate of the slurry is equal to or over a predetermined flow rate of the slurry, circuit means for converting impact pressure to a flow rate provides a first control signal to means for controlling a flow rate to control the slurry supply means, adjusting the flow rate of the slurry supplied to the chemical mechanical polishing apparatus. When the flow rate of the slurry is less than the predetermined flow rate of the slurry, circuit means for converting impact pressure to a flow rate provides a second control signal for interrupting the chemical mechanical polishing process and triggering an alarm. The impact pressure measuring device is disposed in a predetermined position approximating to a polishing platen of the chemical mechanical polishing apparatus and corresponding with an outlet of slurry supply means. Thus, the flow rate of the slurry can be monitored at the outlet of slurry supply means and the flow of the slurry all through the chemical mechanical polishing process is ensured.

BRIEF DESCRIPTION OF THE DRAWINGS

The present invention can be best understood through the following description and accompanying drawings, wherein.

DESCRIPTION OF THE PREFERRED EMBODIMENTS

The present invention provides a system and method for in-situ monitoring slurry flow rate during a chemical mechanical polishing process. The present invention provides an impact pressure measuring device disposed under an outlet of a slurry supplier such that the flow of slurry rushing from the outlet of the slurry supplier would impact the impact pressure measuring device, and the impact pressure of the flow of the slurry is sensed by the impact pressure measuring device. The flow rate of the slurry can then be determined in accordance with the measured impact pressure. Thus, the present invention also provides a method for monitoring a slurry flow rate under the outlet of the slurry supplier such that the flow of the slurry can be ensured all through a chemical mechanical polishing process.

Figure 1A:
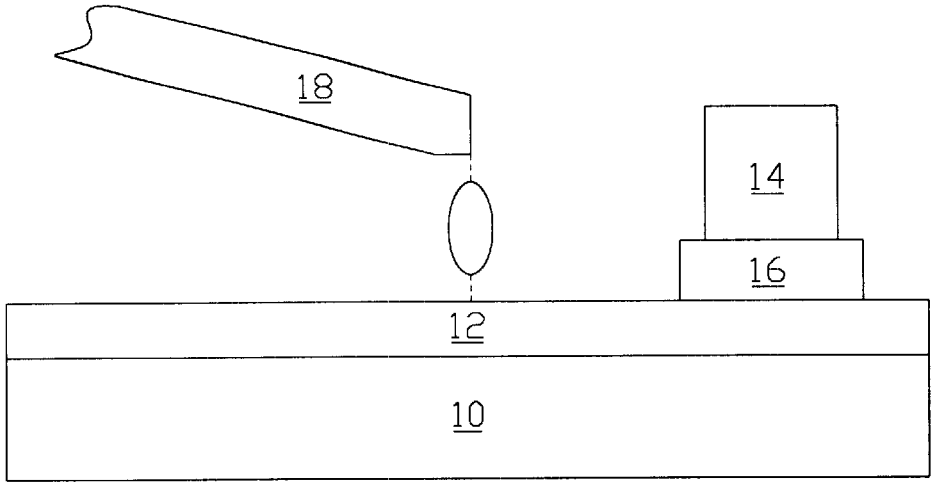
FIG.1A(Prior Art)
FIG. 1A is a schematic cross-sectional view of a conventional chemical mechanical polishing machine.
Figure 1B:
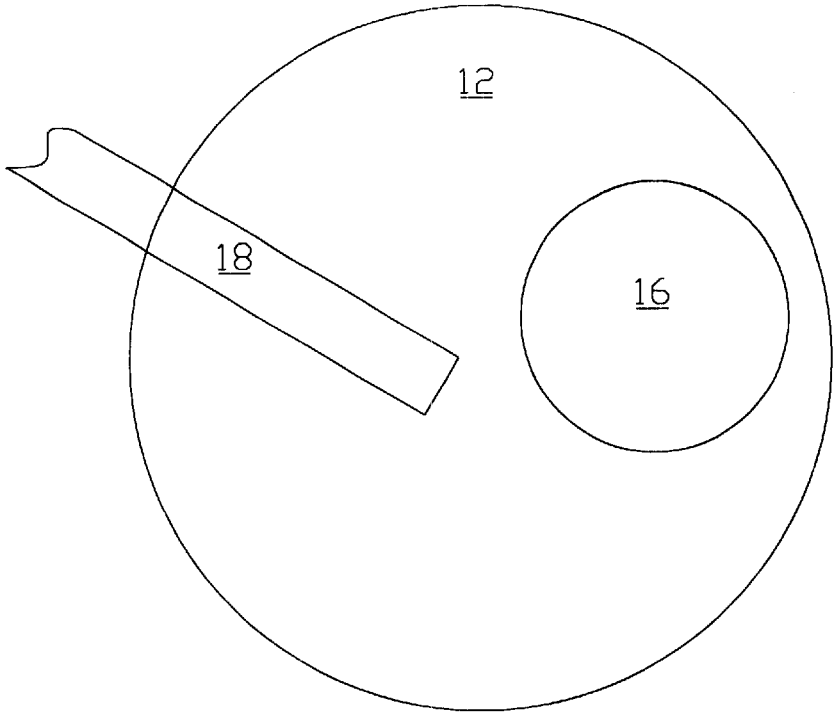
FIG.1B(Prior Art)
FIG. 1B is a schematic top view of the conventional chemical mechanical polishing machine.
Figure 2:
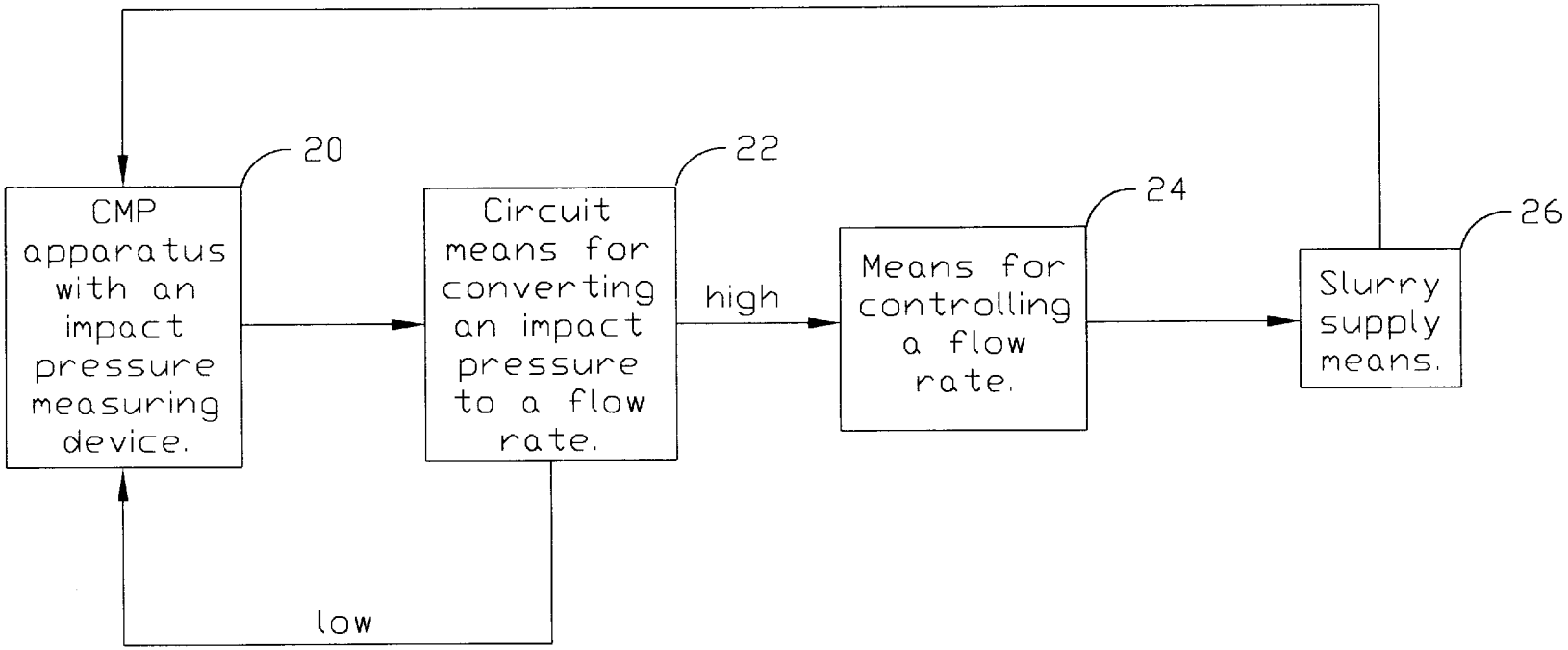
FIG. 2 is a functional block diagram of the present system.

FIG. 2 shows a functional block diagram of the present system, which comprises a chemical mechanical polishing (CMP) apparatus 20 with an impact pressure measuring device, circuit means for converting an impact pressure to a flow rate 22, means for controlling a flow rate 24 and slurry supply means 26. The impact pressure measuring device serves the in-situ monitoring of the impact pressure generated by the slurry flowing through the impact pressure measuring device and then supplied to the chemical mechanical polishing apparatus during a chemical mechanical polishing process. Circuit means for converting an impact pressure to a flow rate 22 is then used to convert the impact pressure of the slurry to the flow rate of the slurry. When the flow rate of the slurry is equal to or over a predetermined flow rate, circuit means for converting impact pressure to a flow rate 22 provides a first control signal to means for controlling a flow rate 24 for controlling slurry supply means 26, adjusting the flow rate of the slurry supplied to the chemical mechanical polishing apparatus 20. When the flow rate of the slurry is less than the predetermined flow rate, circuit means for converting impact pressure to a flow rate 22 provides a second control signal for interrupting the chemical mechanical polishing process and triggering an alarm.

Figure 3A:
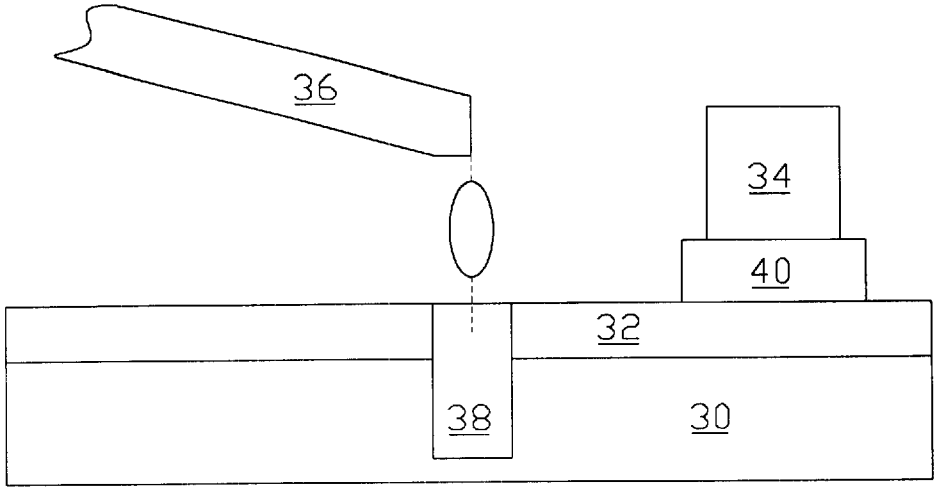
FIG. 3A is a schematic cross-sectional view of a chemical mechanical polishing apparatus according to one preferred embodiment of the present invention.
Figure 3B:
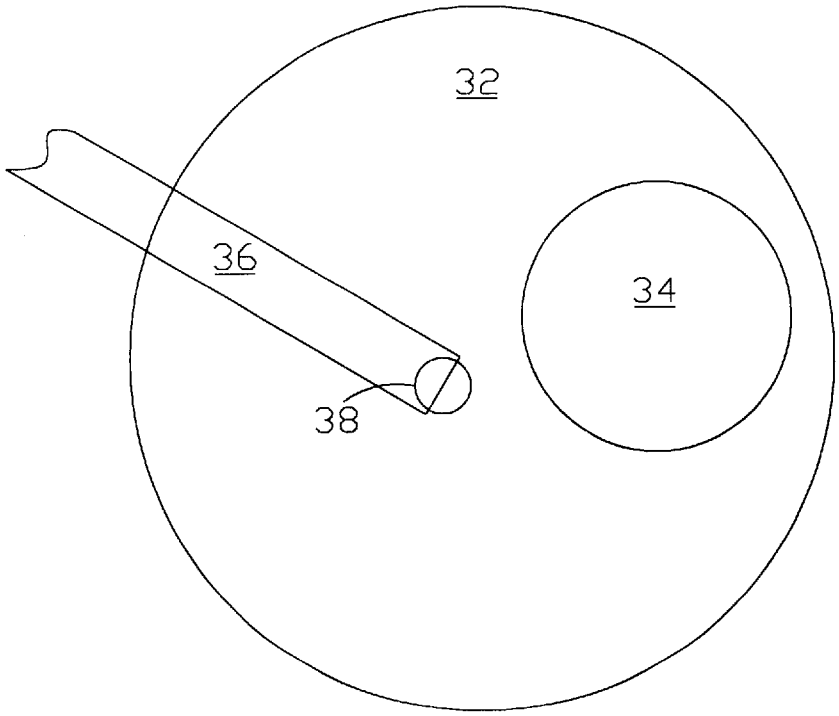
FIG. 3B is a schematic top view of the chemical mechanical polishing apparatus of FIG. 3B.

FIGS. 3A and 3B shows a schematic diagram of the chemical mechanical polishing apparatus 20 according to one preferred embodiment of the present invention, which comprises a polishing platen 30, a polishing pad 32 placed on the polishing platen 30, slurry supply means 36 for supplying slurry onto the polishing pad 32 for polishing a wafer 40, a polishing head 34 for loading the wafer 40 on the polishing pad 32, and impact pressure measuring means 38. Impact pressure measuring means 38 is disposed in a central part of the polishing platen 30, under an outlet of slurry supply means 36, which preferably comprises an injector, and exposing to slurry supply means 36. Impact pressure measuring means 38 can be detachably disposed in the polishing platen 30 or integrally formed with the polishing platen 30. However, the length of impact pressure measuring means 38 protruding from the polishing platen 30 can be adjusted in accordance with a thickness of the polishing pad 32. When a flow of slurry from the outlet of slurry supply means 36 to be supplied onto the polishing pad 32, the flow of slurry would firstly rush to impact pressure measuring means 36, generating a corresponding impact pressure sensed by impact pressure measuring means 36. Therefore, during a chemical mechanical polishing process, impact pressure measuring means 36 can in-situ measure an impact pressure generated by the slurry flowing through. Thereby, the flow rate of the slurry can be determined and controlled in accordance with the measured impact pressure. By the way, the flow of the slurry all through the chemical mechanical polishing process can be ensured.

Figure 4:
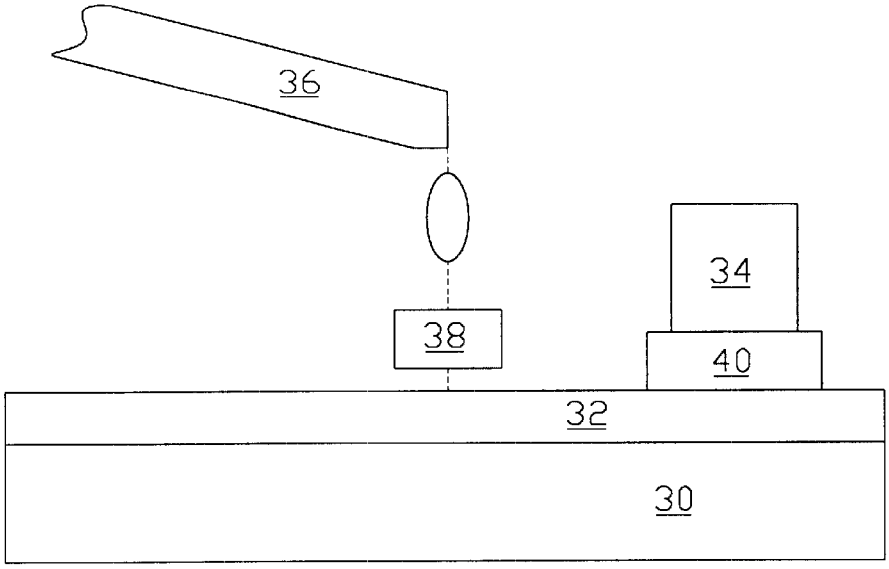
FIG. 4 is a schematic cross-sectional view of a chemical mechanical polishing apparatus according to another preferred embodiment of the present invention.

FIG. 4 is a schematic diagram of the chemical mechanical polishing apparatus 20 according to another preferred embodiment of the present invention. The difference between the above preferred embodiment and this preferred embodiment resides in the fact that impact pressure measuring means 38 is separated from the polishing platen 30, and is placed in a predetermined position between the polishing pad 32 and the outlet of slurry supply means 36.

Specifically, the present invention provides a system for in-situ monitoring slurry flow rate at an outlet of a slurry supplier during a chemical mechanical polishing process so as to ensure the flow of the slurry all through the chemical mechanical polishing process. Therefore, there are some possible variances concerning the relative position of impact pressure measuring means 38 to the polishing platen 30, which are respectively shown in FIG. 5A to FIG. 5F.

Figure 5A:
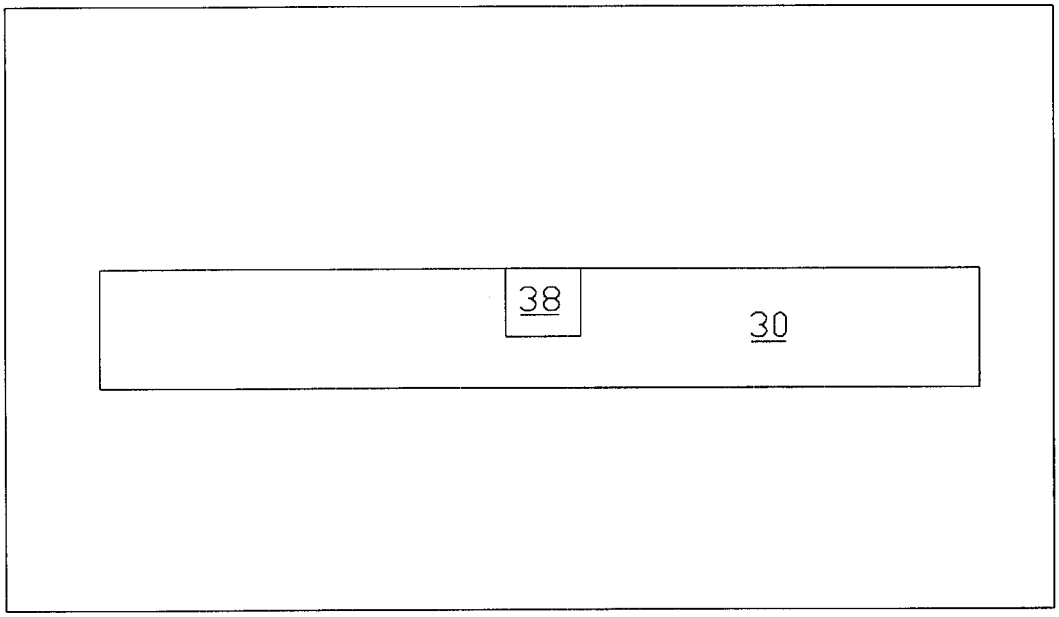
FIG. 5A to FIG. 5F show variances of a combination of impact pressure measuring means and a chemical mechanical polishing apparatus of the present invention.
Figure 5B:
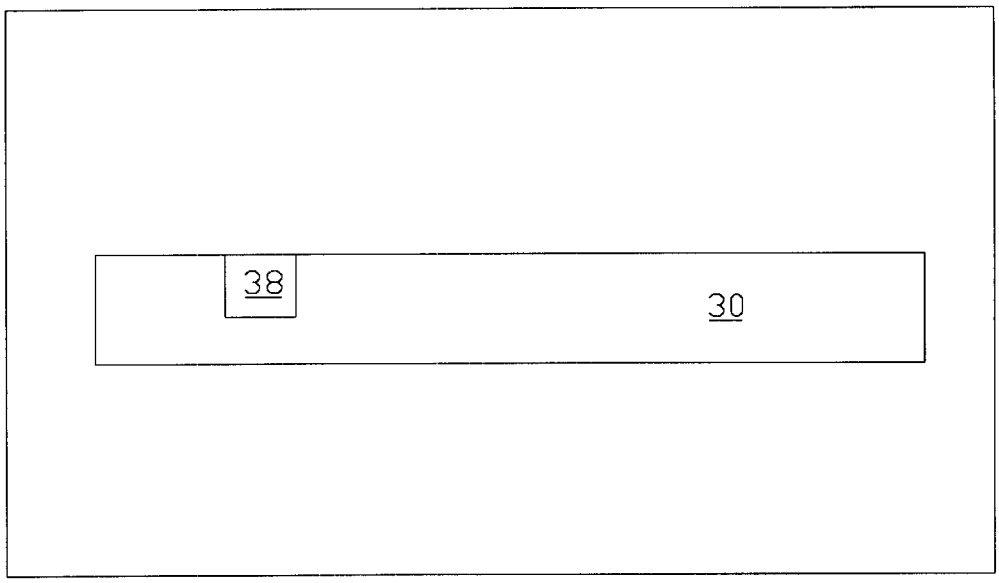
Figure 5C:
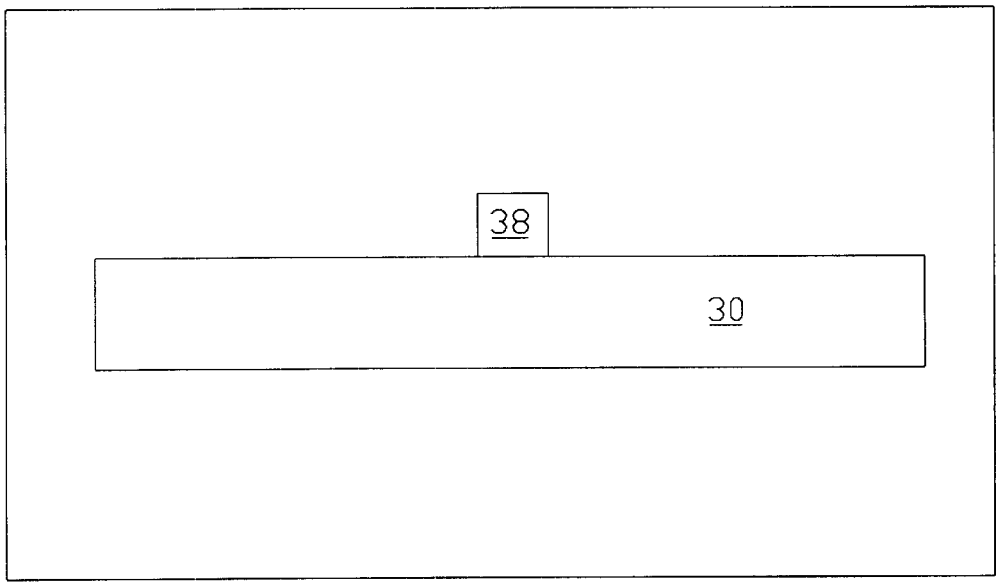
Figure 5D:
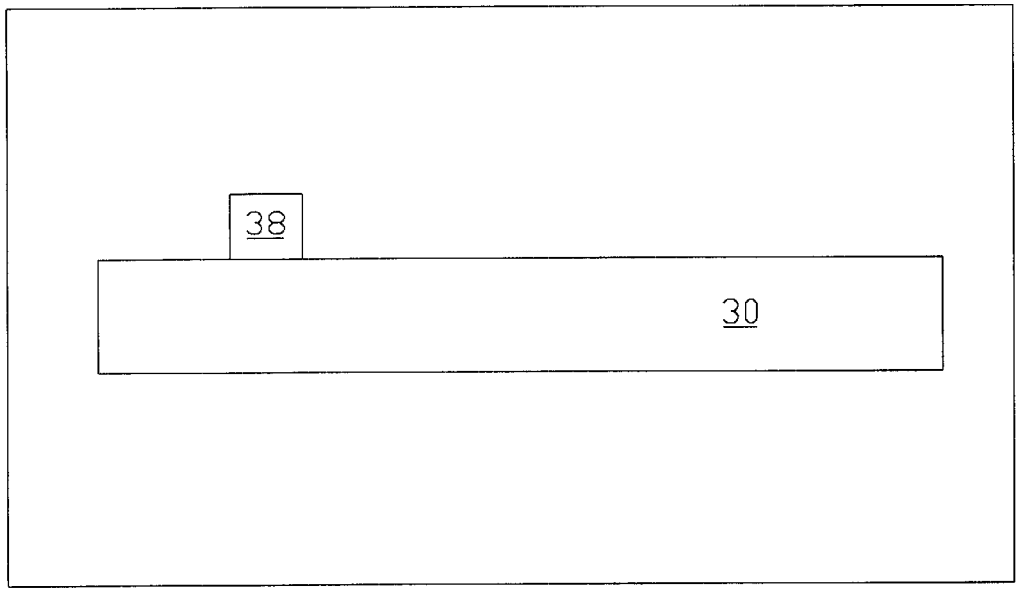

Referring to FIG. 5A and FIG. 5B, impact pressure measuring means 38 is disposed in the polishing platen 30. In FIG. 5A, impact pressure measuring means 38 is disposed in a central part of the polishing platen 30, exposing and corresponding to the outlet of slurry supply means 36. In FIG. 5B, impact pressure measuring means 38 is disposed in a predetermined part of the polishing platen 30 exclusive of the central part of the polishing platen 30, and exposing to and corresponding to the outlet of slurry supply means 36. Referring to FIG. 5C and FIG. 5D, impact pressure measuring means 38 is disposed on a surface of the polishing platen 30. In FIG. 5C, impact pressure measuring means 38 is disposed on a central part of the surface of the polishing platen 30, exposing and corresponding to the outlet of slurry supply means 36. In FIG. 5D, the impact pressure measuring means 38 is disposed on a predetermined part of the surface of the polishing platen 30 exclusive of the central part of the surface of the polishing platen 30, exposing and corresponding to the outlet of slurry supply means 36. The combinations of impact pressure measuring means 38 and the polishing platen 30 also facilitate the polishing pad 32 adhering unto the polishing platen 30.

Figure 5E:
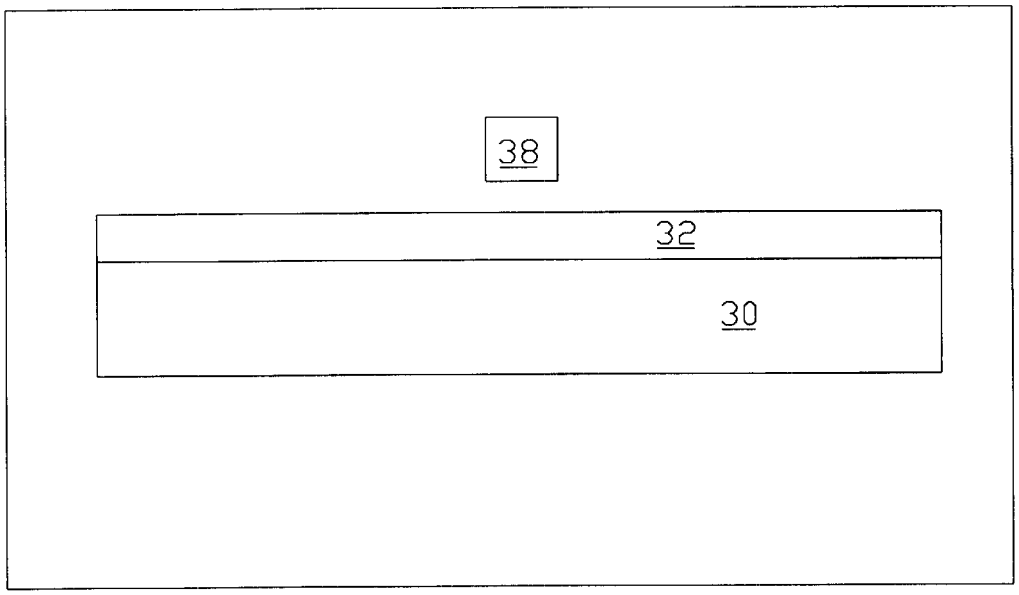
Figure 5F:
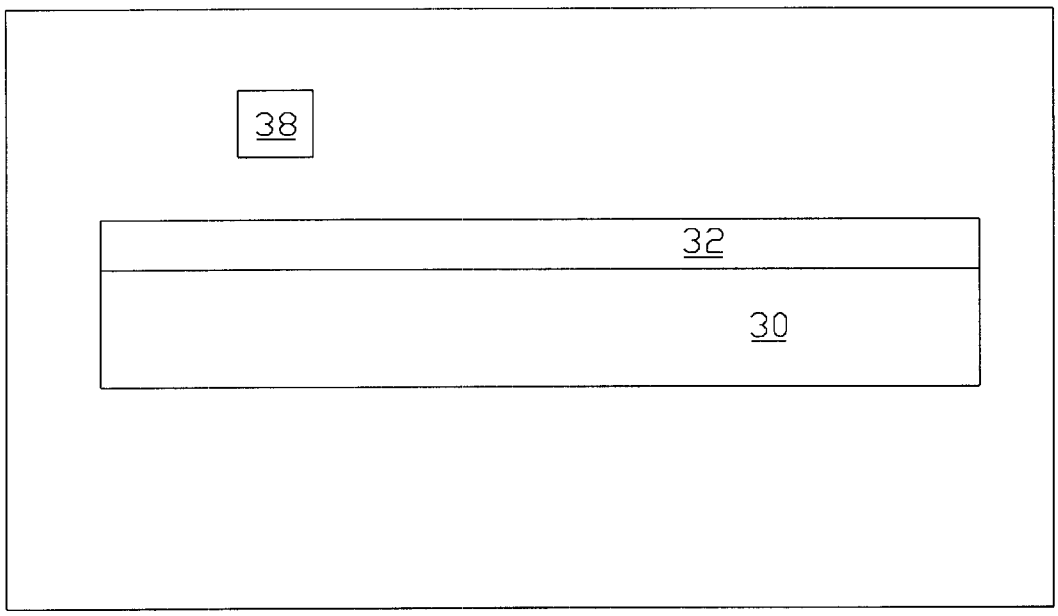

Referring to FIG. 5E and FIG. 5F, impact pressure measuring means 38 is disposed above the polishing platen 30 and the polishing pad 32. In FIG. 5E, impact pressure measuring means 38 is disposed above the central part of the surface of the polishing platen 30, exposing and corresponding to the outlet of slurry supply means 36. In FIG. 5F, impact pressure measuring means 38 is disposed above a predetermined part of the surface of the polishing platen 30 exclusive of the central part of the surface, exposing and corresponding to the outlet of slurry supply means 36.

In accordance with the foregoing, the present invention provides combinations of impact pressure measuring means 38 and the chemical mechanical polishing apparatus 20.

Geometrically, impact pressure measuring means 38 is placed under the outlet of slurry supply means 36. Impact pressure measuring means 38 can be detachably combined with the polishing platen 30 of the chemical mechanical polishing apparatus 20, also can be integrally formed with the polishing plate 30. Besides, the length of impact pressure measuring means 38 protruding from the polishing platen 30 can be adjusted according to the thickness of the polishing pad 32. The flow rate of the slurry determined by impact pressure measuring means 38 can be adjusted and controlled by peripheral means of the chemical mechanical polishing apparatus 20.

The preferred embodiments are only used to illustrate the present invention, not intended to limit the scope thereof. Many modifications of the preferred embodiments can be made without departing from the spirit of the present invention.

What is claimed is:

1. A system for in-situ monitoring slurry flow rate during a chemical mechanical polishing process, comprising:

slurry supply means for providing slurry;

a chemical mechanical polishing apparatus with an impact pressure measuring device, said chemical mechanical polishing apparatus disposed under an outlet of slurry supply means such that said impact pressure measuring device is exposed and corresponding to the outlet of said slurry supply means, said impact pressure measuring device serving for in-situ monitoring of impact pressure generated by slurry flowing through said impact pressure measuring device and then supplied to said chemical mechanical polishing apparatus during a chemical mechanical polishing process;

circuit means for converting impact pressure to a flow rate, serving for converting the impact pressure to a flow rate of the slurry; and means for controlling a flow rate;

wherein when the flow rate of the slurry is not less than a predetermined flow rate, said circuit means for converting impact pressure to a flow rate providing a first control signal to said means for controlling a flow rate for controlling said slurry supply means, adjusting the flow rate of the slurry supplied to said chemical mechanical polishing apparatus, and when the flow rate of the slurry is less than the predetermined flow rate, said circuit means for converting impact pressure to a flow rate providing a second control signal for interrupting the chemical mechanical polishing process and triggering an alarm.

2. The system of claim 1, wherein said impact pressure measuring device is disposed in a polishing platen of said chemical mechanical polishing apparatus.

3. The system of claim 1, wherein said impact pressure measuring device is disposed on a surface of a polishing platen of said chemical mechanical polishing apparatus.

4. The system of claim 1, wherein said impact pressure measuring device is disposed above a surface of a polishing platen of said chemical mechanical polishing apparatus.

5. The system of claim 1, wherein said slurry supply means comprises an injector.

6. A chemical mechanical polishing apparatus for in-situ monitoring slurry flow rate during a chemical mechanical polishing process, comprising:

a polishing platen;

a polishing pad on said polishing platen;

slurry supply means for supplying slurry onto said polishing platen for polishing a wafer;

a polishing head for loading the wafer on said polishing pad; and impact pressure measuring means disposed under an outlet of slurry supply means, and exposing and corresponding to the outlet of slurry supply means for in-situ measuring an impact pressure generated by the slurry flowing through during a chemical mechanical polishing process, wherein a flow rate of the slurry is controlled in accordance with the measured impact pressure.

7. The chemical mechanical polishing apparatus of claim 6, wherein said impact pressure measuring means is disposed in said polishing platen.

8. The chemical mechanical polishing apparatus of claim 6, wherein said impact pressure measuring means is disposed on a surface of said polishing platen.

9. The chemical mechanical polishing apparatus of claim 6, wherein said impact pressure measuring means is disposed above a surface of said polishing platen.

10. The chemical mechanical polishing apparatus of claim 6, herein said slurry supply means comprises an injector.

11. A method for in-situ monitoring slurry flow rate during a chemical mechanical polishing process, comprising:

supplying slurry with a flow rate unto a chemical mechanical polishing apparatus comprising an impact pressure measuring device during a chemical mechanical polishing process, said impact pressure measuring device in-situ measuring impact pressure of the slurry under an outlet of slurry supply means when the slurry passing through said impact pressure measuring device;

converting the impact pressure provided by said impact pressure measuring device to the flow rate of the slurry; and adjusting the flow rate of the slurry supplied unto a chemical mechanical polishing apparatus when the flow rate of the slurry is not less than a predetermined flow rate, and interrupting the chemical mechanical polishing process and triggering an alarm when the flow rate of the slurry is less than the predetermined flow rate.

* * * * *